US005810204A

United States Patent [19]

Devlin et al.

[11] Patent Number: 5,810,204

[45] Date of Patent: Sep. 22, 1998

[54] APPARATUS FOR DISPENSING LIQUID SOAP OR OTHER LIQUIDS

[75] Inventors: John Devlin, Tewksbury; Dave Carpenter, Pepperell, both of Mass.

[73] Assignee: James River Corporation, Richmond, Va.

[21] Appl. No.: 732,106

[22] Filed: Oct. 15, 1996

[51] Int. Cl.[6] ..... B67D 5/42

[52] U.S. Cl. ..... 222/82; 222/88; 222/95; 222/108; 222/156; 222/207; 222/214; 222/287; 222/325; 222/321.1; 222/372

[58] Field of Search ..... 222/82, 88, 95, 222/105, 108, 156, 207, 214, 287, 288, 325, 321.1, 372

[56] References Cited

U.S. PATENT DOCUMENTS

| | | | |
|---|---|---|---|
| 4,238,056 | 12/1980 | Tucker et al. | 222/325 X |
| 4,345,627 | 8/1982 | Cassia | 222/325 X |
| 4,778,085 | 10/1988 | Bush et al. | 222/207 |
| 5,174,476 | 12/1992 | Steiner et al. | 222/207 X |
| 5,421,489 | 6/1995 | Holzner et al. | 222/207 |
| 5,464,125 | 11/1995 | Daansen | 222/214 X |
| 5,465,877 | 11/1995 | Bell et al. | 222/207 X |
| 5,611,465 | 3/1997 | Lee et al. | 222/214 |

*Primary Examiner*—Kenneth Bomberg
*Attorney, Agent, or Firm*—Burns, Doane, Swecker & Mathis, L.L.P.

[57] ABSTRACT

Apparatus for dispensing liquid soap or other liquid from either a bag-in-box liquid container or from a bottle of liquid includes a housing. A dispenser actuator is movably mounted on the housing. A first module is provided for insertion into the interior of the housing, the first module including a bottle support and a liquid pump for pumping liquid from the bottle. A second module can also be inserted into the housing interior, the second module including a bag-in-box container support. The modules are selectively alternatively mountable within the housing interior and each of the modules is cooperable with the dispenser actuator when in the housing interior to dispense liquid from the housing interior to a location exterior of the housing responsive to movement of the dispenser actuator relative to the housing.

25 Claims, 17 Drawing Sheets

APPARATUS FOR DISPENSING LIQUID SOAP OR OTHER LIQUIDS

TECHNICAL FIELD

This invention relates to apparatus for dispensing liquids. The invention has particular application to the dispensing of liquid soaps, lotions, shampoos and similar substances.

BACKGROUND OF THE INVENTION

Many types of dispensers have been and are being utilized to dispense liquid soap and similar substances. The liquid to be dispensed can be poured directly into reservoirs of certain of these dispensers. Other dispensers exist which are to be utilized in combination with bottles formed of plastic or other material which supply the liquid. Still other devices are known which are for the purpose of dispensing soap or other similar liquid products from bag-in-box containers incorporating collapsible plastic bags within an outer box of paperboard material or the like.

Conventional prior art dispenser devices are not suitable for dispensing soap or other liquids from both bag-in-box liquid containers and bottles of liquid.

DISCLOSURE OF THE INVENTION

The apparatus of the present invention is for the purpose of dispensing liquid soap or other liquid from either a bag-in-box liquid container or from a bottle of liquid.

The apparatus is characterized by its relative simplicity and ease of use. Only a slight modification of the apparatus need be made to convert it to bag-in-box liquid container use from use with a bottle of liquid or vice versa. Such conversion is readily and quickly accomplished.

The apparatus includes a housing defining a housing interior. Dispenser actuator means is movably mounted on the housing.

The apparatus also includes a first module for insertion into the housing interior. The first module includes a bottle support for supporting a bottle of liquid and a liquid pump for pumping liquid from the bottle.

The apparatus also includes a second module for insertion into the housing interior. The second module includes a bag-in-box container support for supporting a bag-in-box container having liquid therein.

Mounting means is provided for selectively alternatively mounting the first module and the second module on the housing within the housing interior. Each of the modules is cooperable with the dispenser actuator means when in the housing interior to dispense liquid from the housing interior to a location exterior of the housing responsive to movement of the dispenser actuator means relative to the housing.

Other features, advantages, and objects of the present invention will become apparent with reference to the following description and accompanying drawings.

BEST MODE FOR CARRYING OUT THE INVENTION

Figure 1:
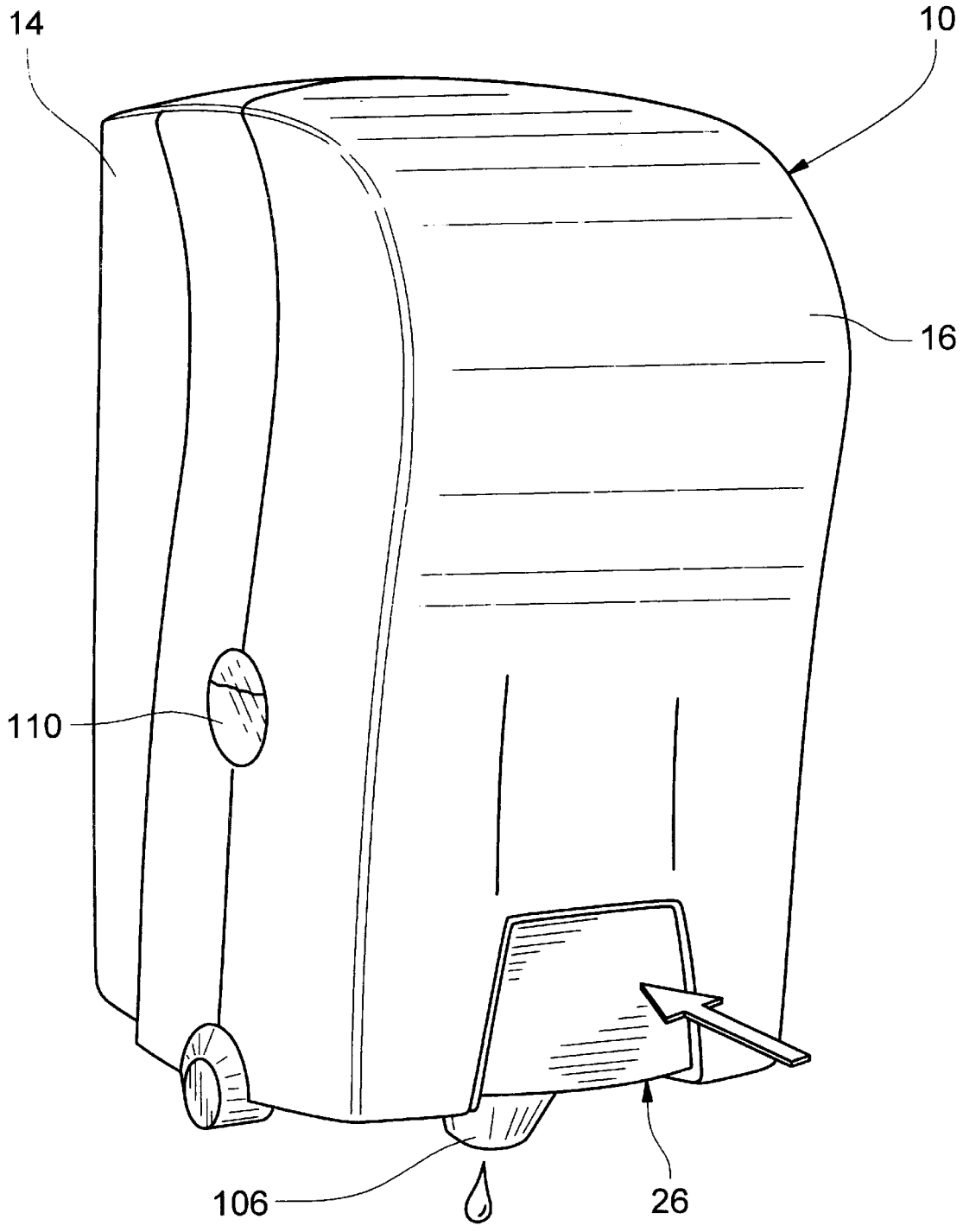
FIG. 1 is a perspective view of the apparatus including a closed housing and a manually depressed portion of a dispenser actuator, illustrating a pushing force being applied to the dispenser actuator and liquid soap being dispensed from the apparatus.

Referring now to the drawings, apparatus constructed in accordance with the teachings of the present invention includes a housing 10 defining a housing interior 12. The housing includes a first housing member 14 and a second housing member 16, the latter being a cover which is hingedly connected to the first housing member and movable between a closed position shown in FIG. 1 and an open position (shown in FIG. 2, for example).

Figure 2:
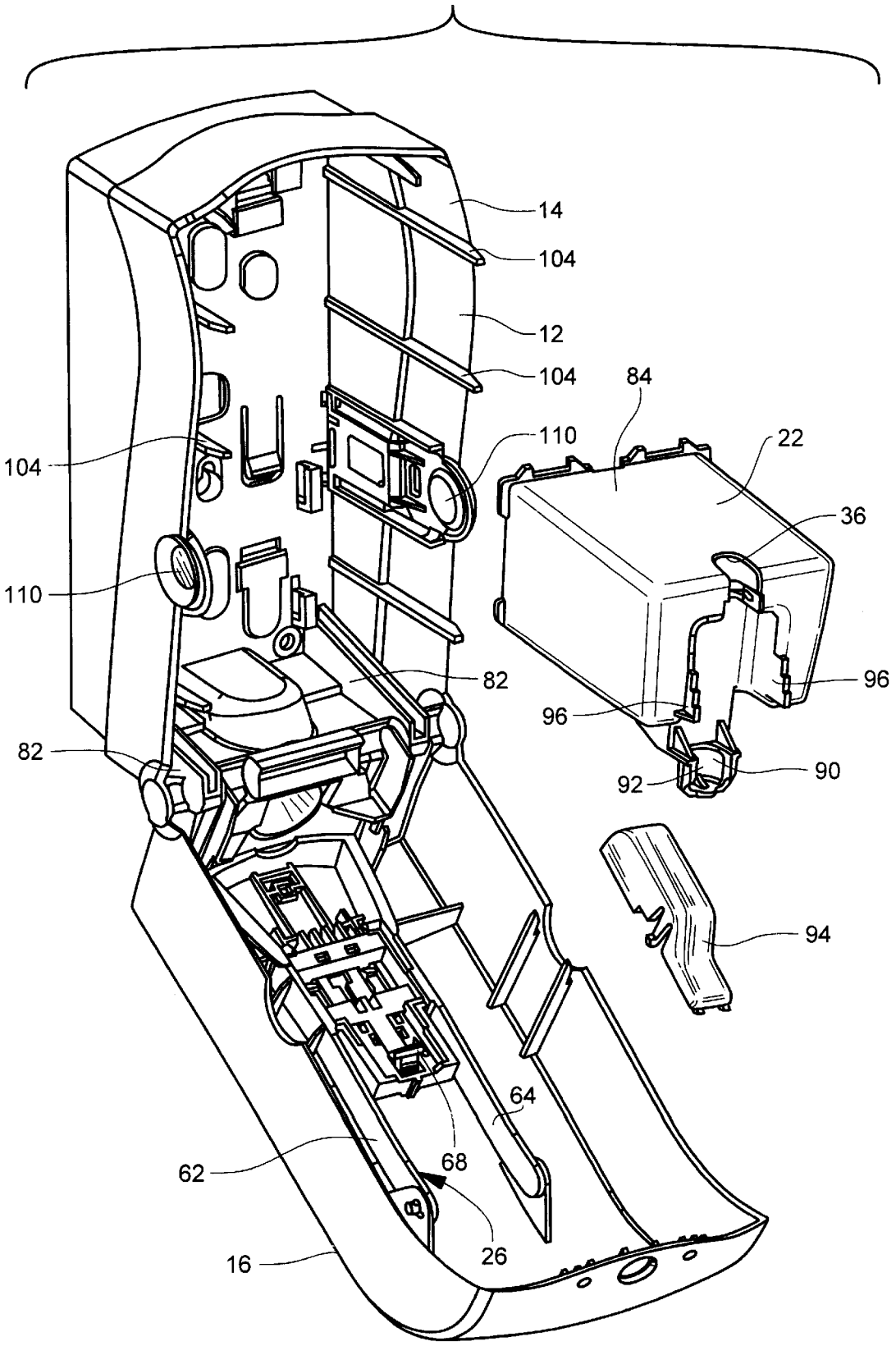
FIG. 2 is an exploded perspective view with the housing opened to disclose the interior thereof, a module for supporting a bag-in-box container having an outlet tube and an outlet tube engagement member for releasable attachment to the dispenser actuator.
Figure 3:
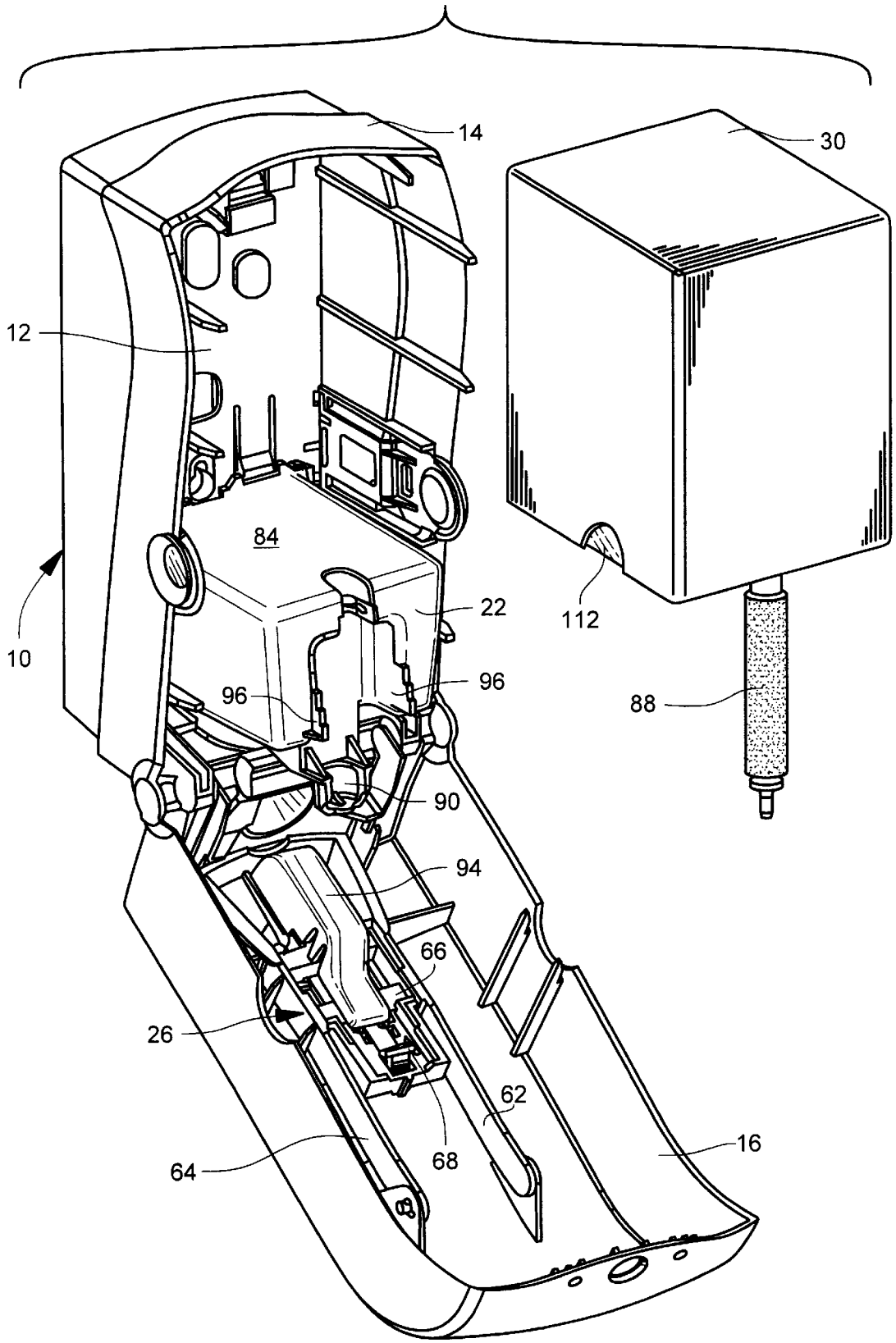
FIG. 3 is a perspective view of the open housing, a module positioned in the housing, a bag-in-box liquid container just prior to placement thereof on the module, and the outlet tube engagement member attached to the dispenser actuator.
Figure 4:
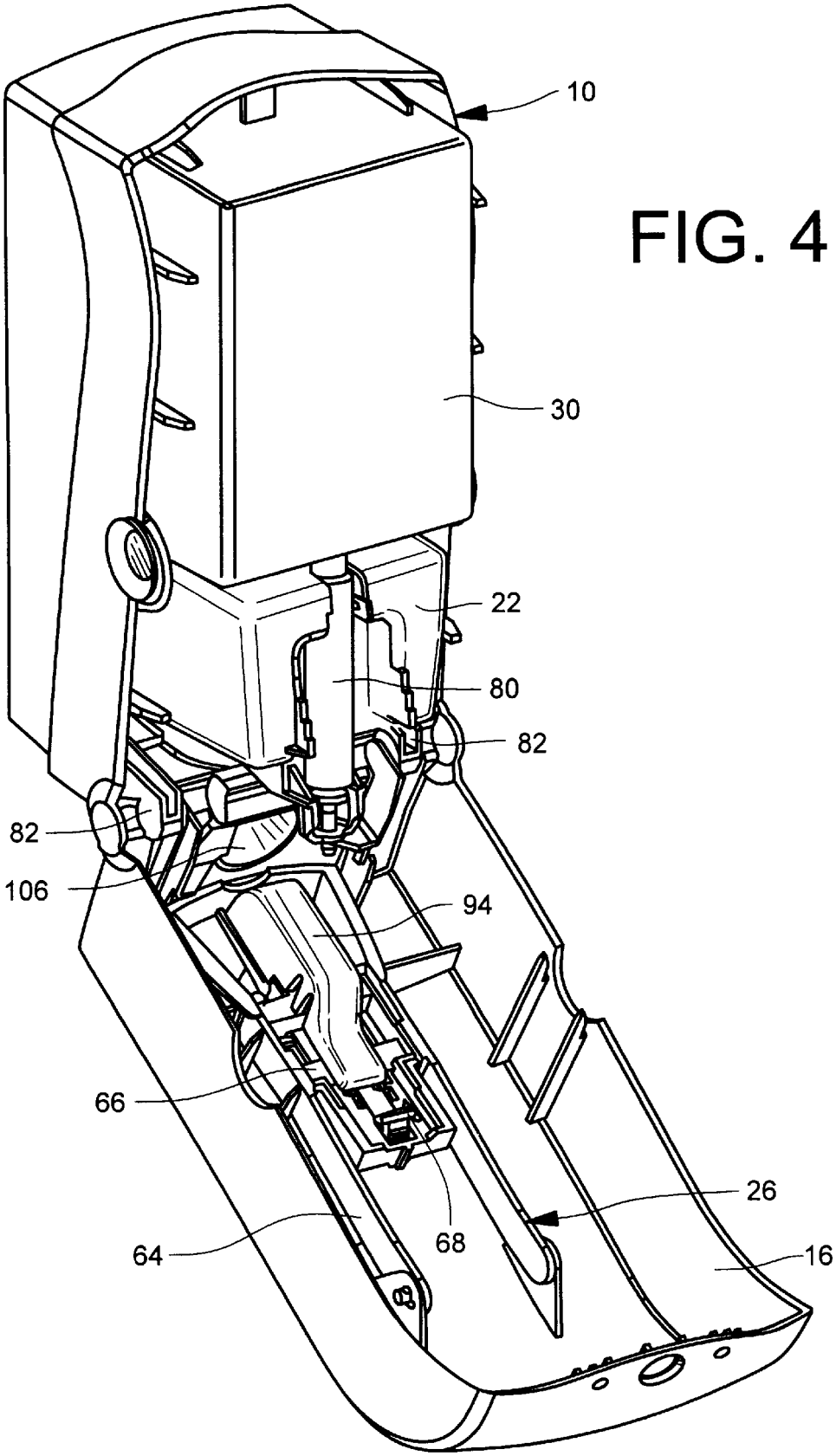
FIG. 4 is a view similar to FIG. 3 illustrating the bag-in-box container supported by the module and positioned within the housing interior.
Figure 5:
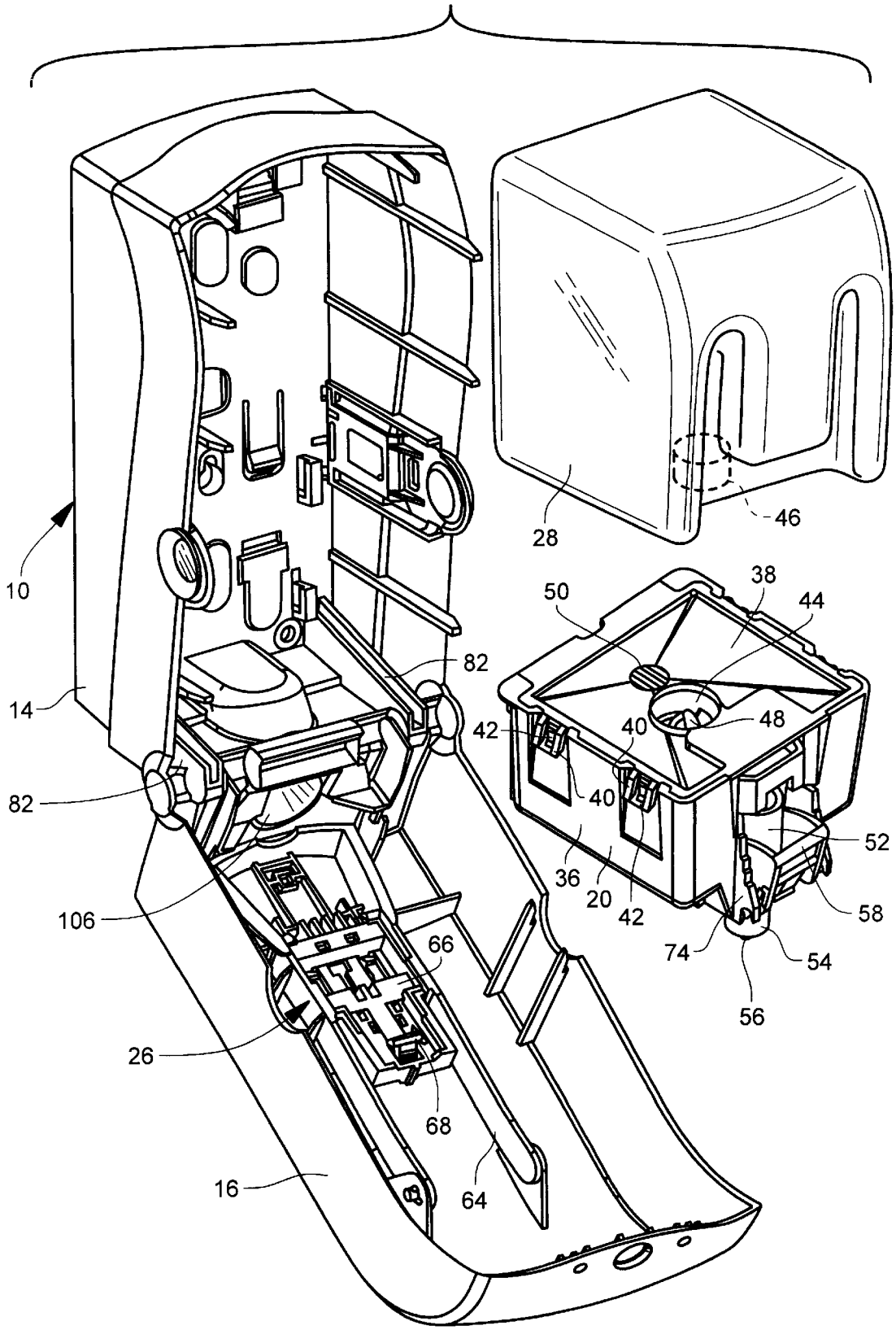
FIG. 5 is an exploded perspective view illustrating the open housing, a bottle of liquid, and a different module for supporting the bottle of liquid.

The housing 10 is for alternative use with a first module 20 (FIGS. 5, 6, 7 and 8) and a second module 22 (FIGS. 2, 3 and 4). The first module is for the purpose of adapting the housing and a dispenser actuator 26 movably mounted on cover 16 of the housing to dispense liquid soap or other liquid from a bottle 28 (FIGS. 5, 6, 7 and 8) containing liquid to dispense the liquid from the housing interior to a location exterior of the housing responsive to movement of the dispenser actuator 26 relative to the housing.

The second module 22, on the other hand, adapts the housing and dispenser actuator to dispense liquid soap or other liquid in a bag-in-box liquid container 30 (FIGS. 3, 4, 27 and 28) from the housing interior to a location exterior of the housing responsive to movement of the dispenser actuator relative to the housing when the second module 22 supports the bag-in-box liquid container.

Figure 6:
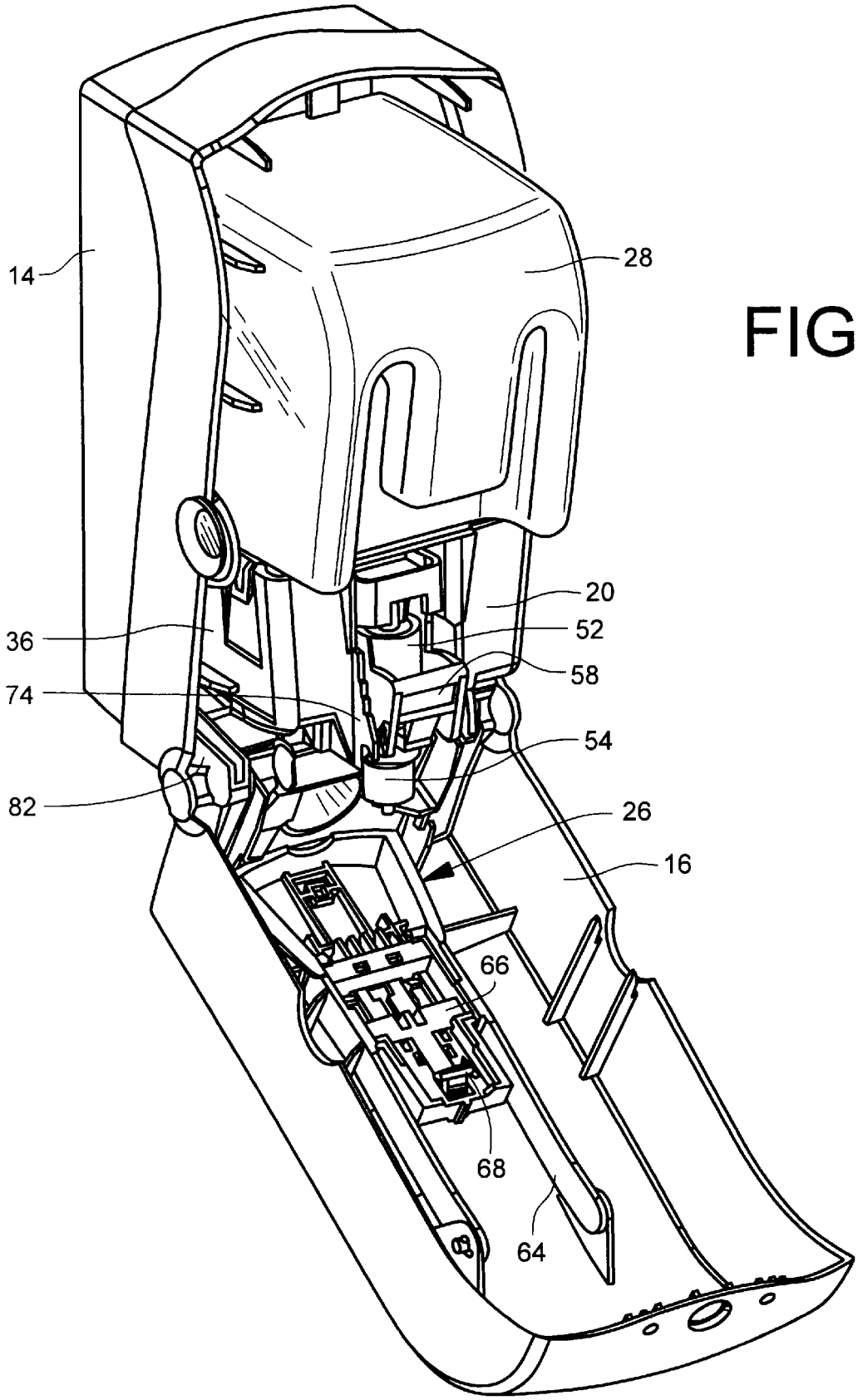
FIG. 6 is a perspective view showing the module of FIG. 5 in position within the housing interior and supporting the bottle of liquid.
Figure 7:
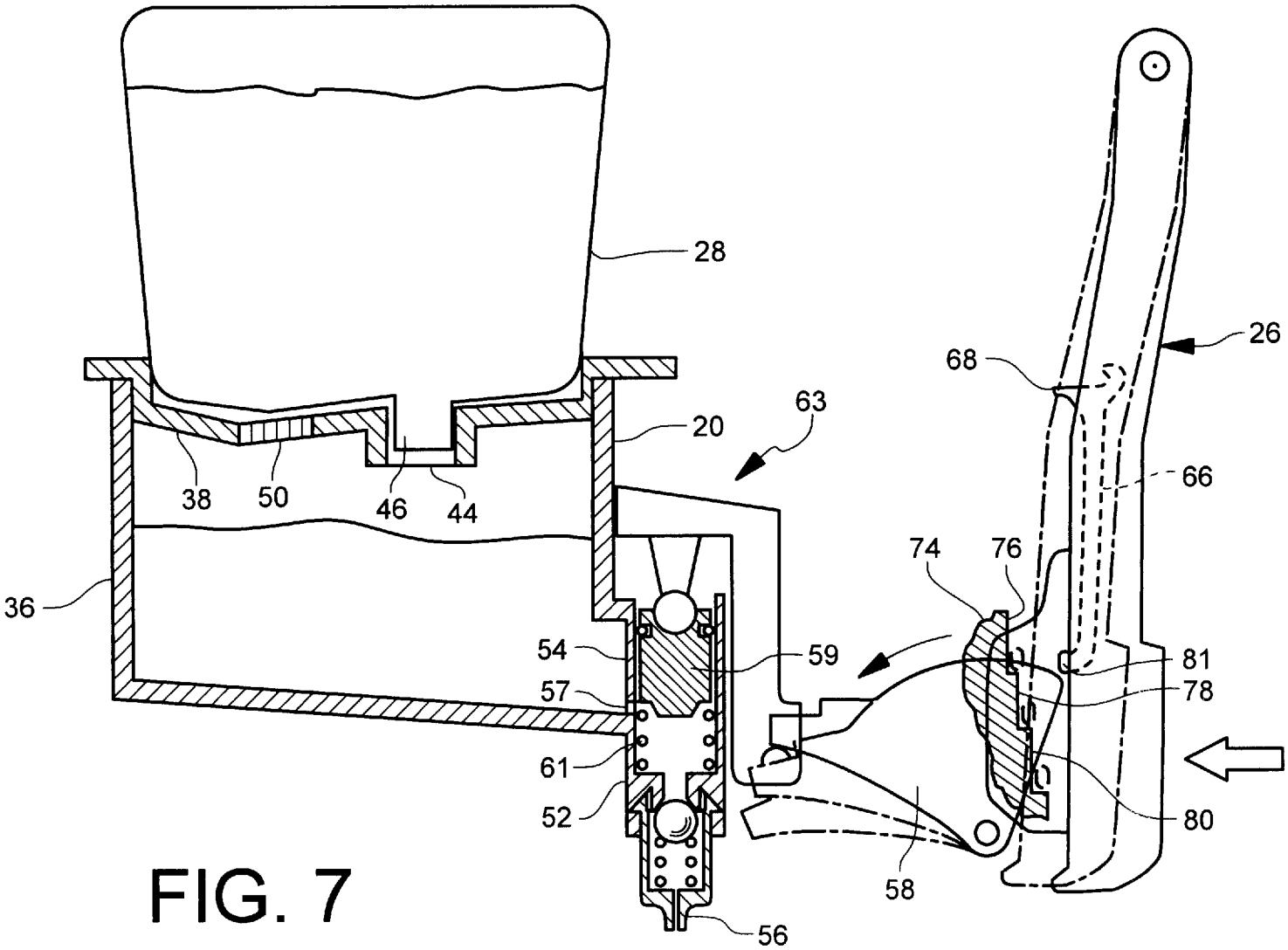
FIG. 7 is schematic elevation view in section illustrating the cooperative relationships between the module of FIG. 5 and the dispenser actuator, and further schematically illustrating structure of the module pump, the dispenser actuator, and structure for limiting movement of the dispenser actuator to control the amount of dispensed liquid.
Figure 8:
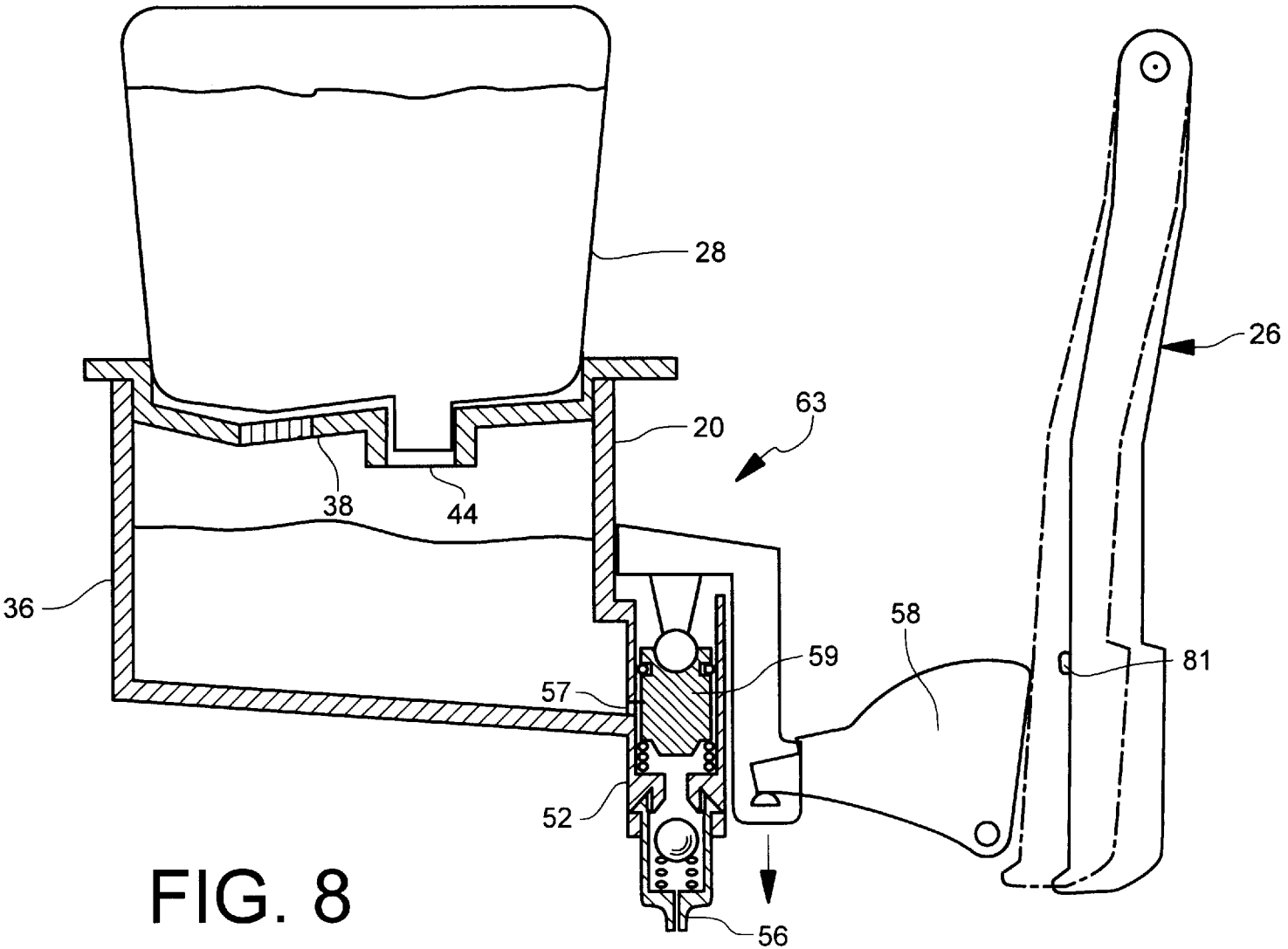
FIG. 8 is a view similar to FIG. 7 but illustrating actuation of the pump of the module by the dispenser actuator.
Figure 12:
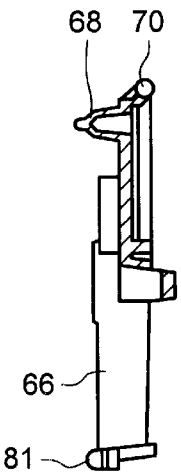
FIG. 12 is a cross-sectional view taken along the line 12—12 of FIG. 10.
Figure 11:
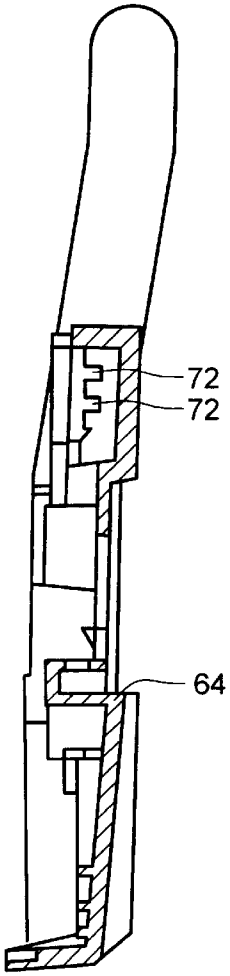
FIG. 11 is a cross-sectional view taken along the line 11—11 of FIG. 9.
Figure 10:
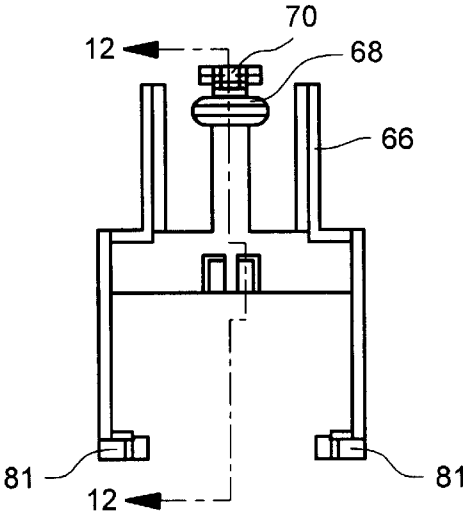
FIG. 10 is a front elevation view of a contact member to be slidably mounted on the framework.
Figure 9:
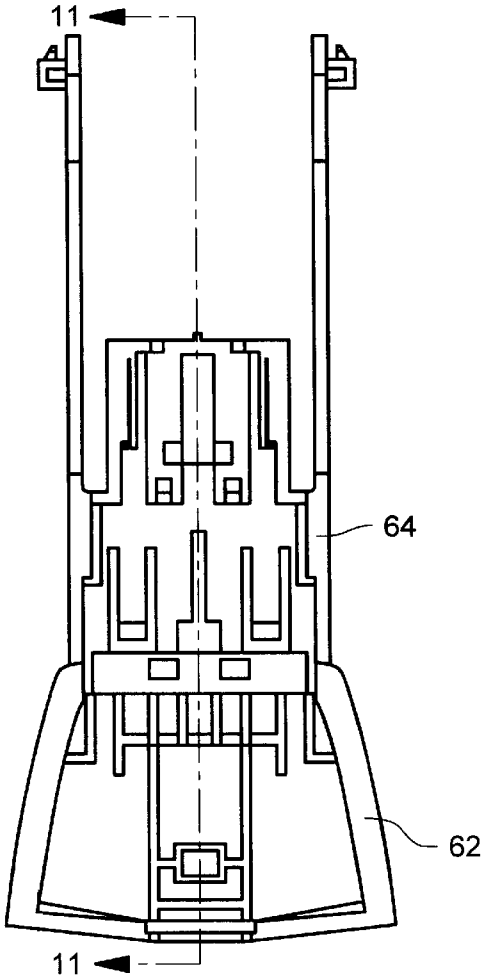
FIG. 9 is a rear elevation view of an actuator body including a framework employed in the apparatus.
Figure 13:
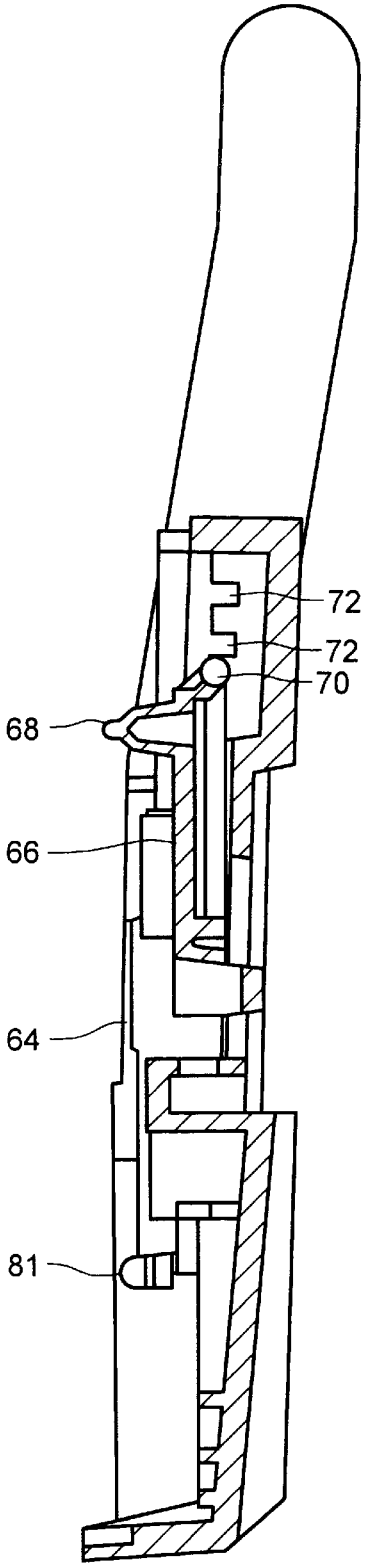
FIG. 13 is a cross-sectional view illustrating the contact member mounted on the framework and showing a contact member detent in place between framework teeth.
Figure 14:
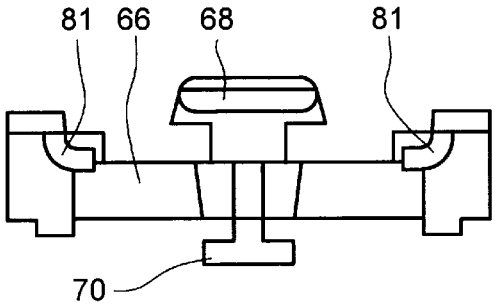
FIG. 14 is an end view of the contact member.
Figure 15:
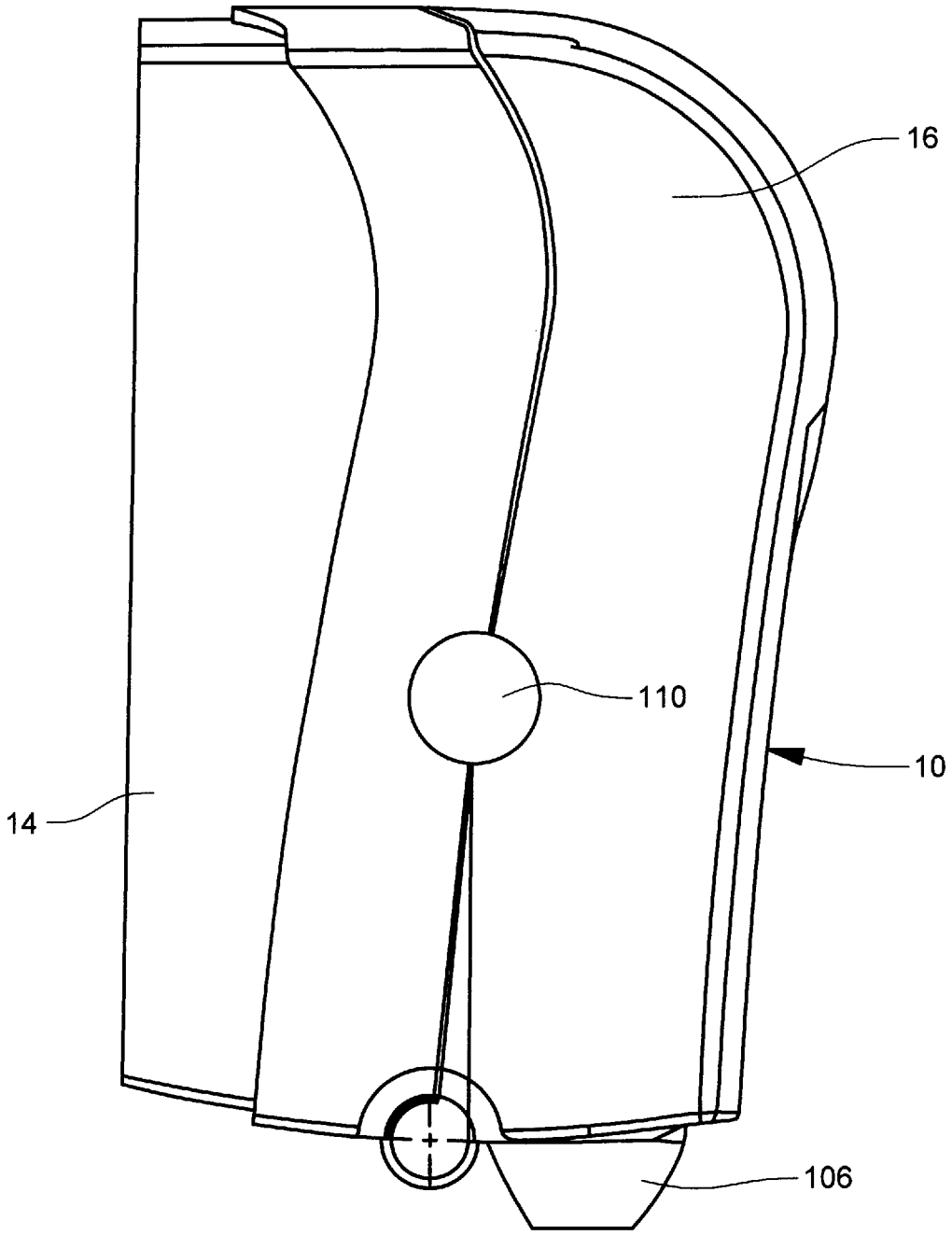
FIG. 15 is a side view of the apparatus with the housing in closed condition.
Figure 16:
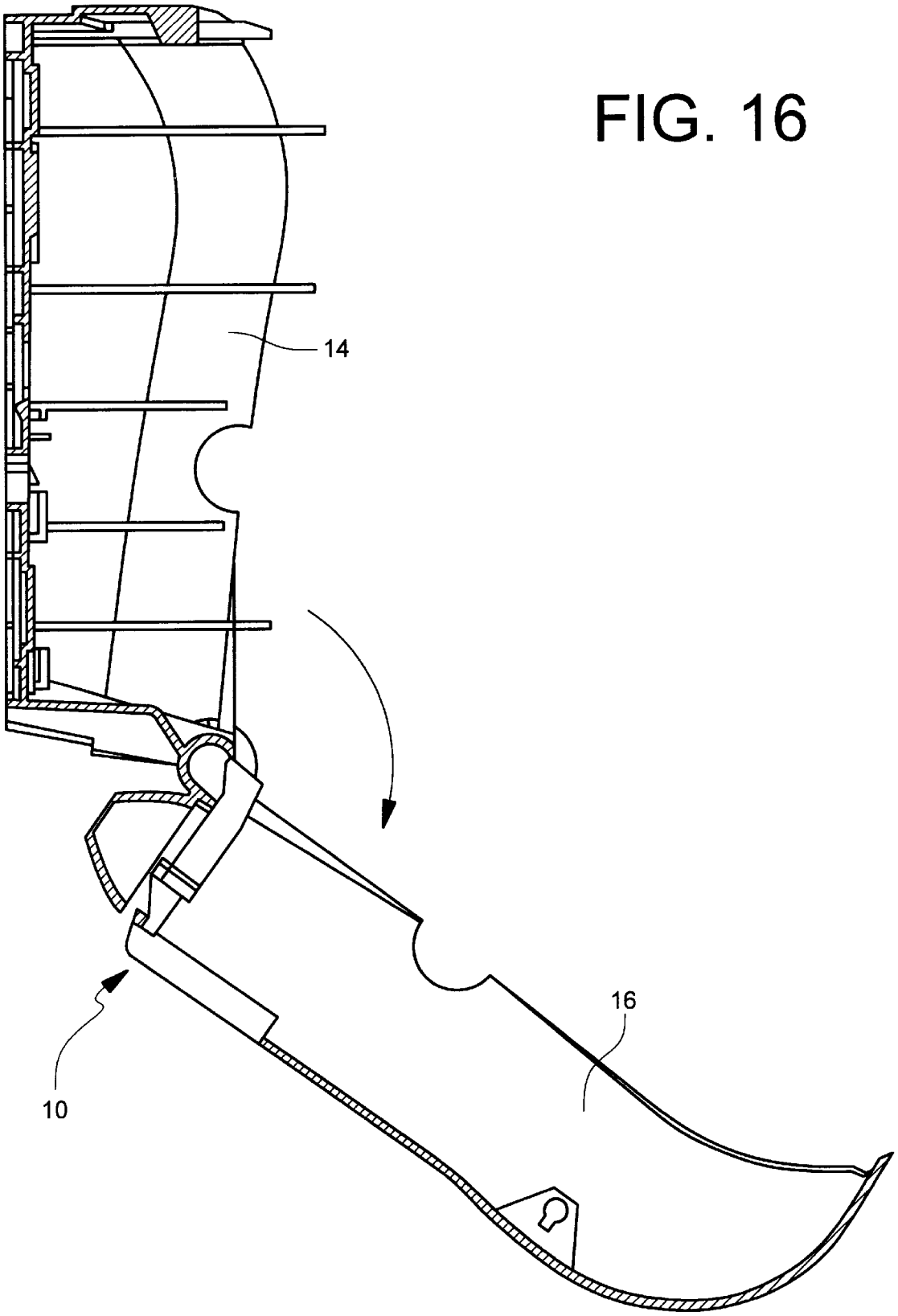
FIG. 16 is a cross-sectional side view of the apparatus illustrating the housing in open condition.
Figure 17:
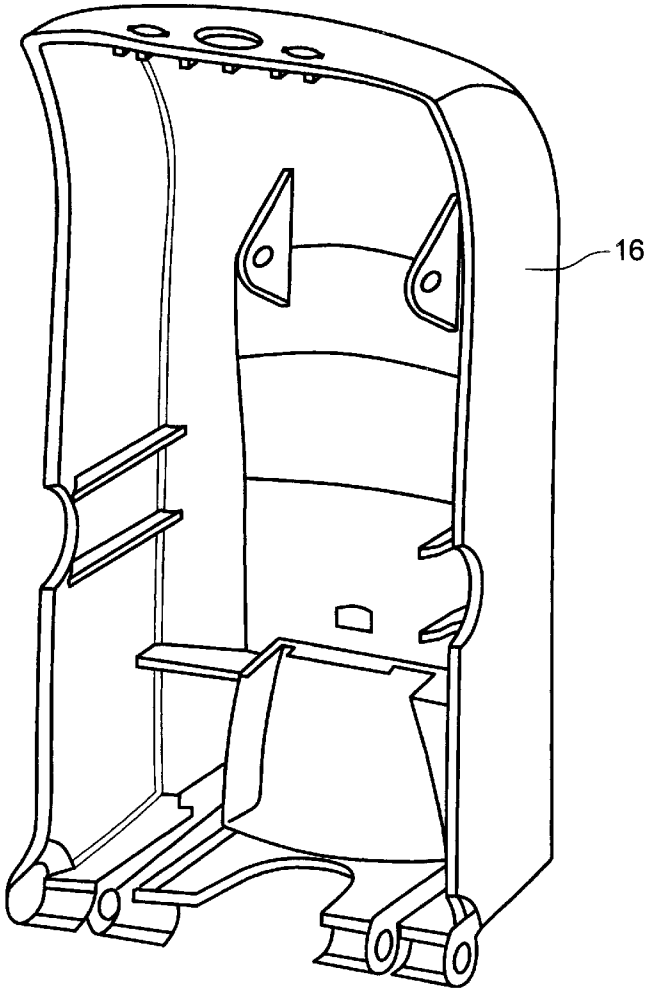
FIG. 17 is an interior perspective view of one housing member.
Figure 18:
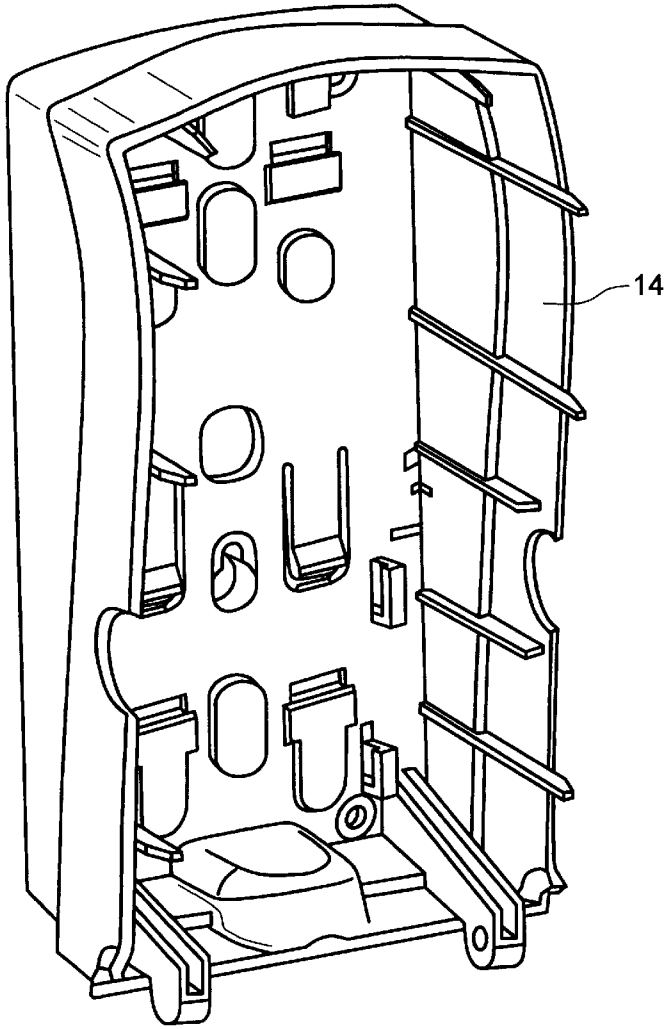
FIG. 18 is an interior perspective view of the other housing member.
Figure 21:
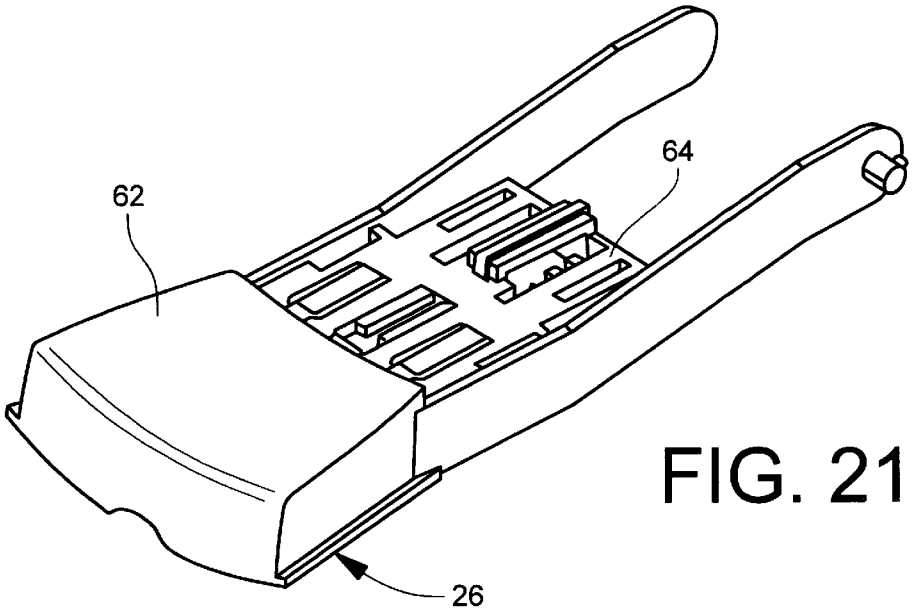
FIG. 21 is a perspective view of the actuator body framework.

Referring now to FIGS. 6, 7 and 8, the operation of the apparatus when the first module 20 is disposed within the housing interior will now be described. First module 20 has a generally box-like configuration including a four sided module body 36 forming a reservoir. A module cover 38 is releasably held in a position over the reservoir by snap fasteners 40 (FIG. 5) having openings therein which receive detents 42 on the module body. It will be appreciated that the module cover may readily be selectively positioned on the module body or removed therefrom.

An opening 44 is defined by the cover 38 and leads to the reservoir. The cover 38 supports bottle 28, the bottle being positioned upside down with the spout or outlet 46 thereof located at opening 44 so that the liquid contents of the bottle enter the reservoir. It is desirable (and relatively common practice) to employ seal members at the outlets of bottles to protect and prevent accidental spilling of the liquid in the bottle until the bottle is employed for dispensing purposes. Such seal, for example, may be formed of plastic, foil, or a suitable laminate. To accommodate and cooperate with such bottles, a sharp piercing element 48 is incorporated in the module cover structure and projects upwardly at the location of opening 44 so that the seal will be pierced when the bottle 28 is placed into position.

An air vent 50 is also defined by the cover and the cover inclines downwardly toward the air vent to form a liquid drainage basin so that spillage, if such occurs, will flow downwardly through the air vent 50 and into the reservoir.

Disposed at the front of the first module 20 and comprising an element thereof is a liquid pump 52. Liquid pump 52 includes a rigid pump cylinder 54 having an outlet 56. The interior of the cylinder receives liquid from the reservoir of module body 36 through an opening 57 (FIGS. 7 and 8) providing communication between the reservoir and the cylinder interior. A spring biased piston 59 is disposed within the cylinder 54, the piston being biased in an upward direction by the spring 61.

A pump actuator member 58 is pivotally connected to the rest of the first module and linkage (schematically disclosed and designated generally by reference number 63 in FIGS. 7 and 8) extends between the member 58 and the piston within the pump cylinder. If the pump actuator member 58 is pushed and pivoted, the linkage imparts downward movement to the piston to dispense liquid through cylinder outlet 56 from the interior of the housing to a location exterior thereof. Such an arrangement prevents downward force being applied to the housing by the person actuating the dispenser which may have a tendency to pull the housing from the surface upon which it is mounted over time.

Dispenser actuator 26 includes an actuator body 62 pivotally connected to second housing member 16. The actuator body 62 includes a framework 64 bifurcated at an end thereof pivotally attached to second housing member 16 and a contact member 66 which is slidably mounted relative to framework 64 and selectively positionable relative thereto. A lever member 68 is located at one end of the contact member and is utilized to selectively position the contact member relative to the framework at selected positions. More particularly, the lever member 68 is utilized upon inward deflection thereof to manually disengage a detent 70 at the opposed side the contact member from teeth 72 projecting from the framework in the direction of the contact member. In other words, the contact member may be manually slid in a longitudinal direction relative to the framework and selectively positioned at one of a plurality of preselected locations on the framework by deploying the detent between different teeth.

Referring once again to the structure of the module 20, the module has stepped walls 74 on both sides of the movable pump actuator member 58, the stepped walls 74 each having a plurality of abutment surfaces 76, 78 and 80 (FIG. 7) which are alternatively selectively engageable by ends 81 of contact member 66 when the actuator body 62 is pushed inwardly to in turn push against pump actuator member 58 and cause dispensing of liquid from pump cylinder 54 caused by downward movement of the piston. Movement of the actuator body 62 and the pump actuator member 58 will cease when the ends 81 of the contact member 66 engage the abutment surfaces. This, of course, will terminate flow of pumped liquid through the outlet 56. The location of contact member 66 on the framework will determine which of the abutment surfaces are engaged by the contact member and the degree of movement of the actuator body and actuator member (along with the piston) will be determined by the abutment surfaces engaged.

As indicated above, a module 22 may be employed in the housing rather than the module 20. These first and second modules may be readily interchanged depending upon whether one wishes to dispense from a bottle of liquid such as bottle 28 or a bag-in-box liquid container 30. The modules are similarly sized so that interchange can take place with a minimum of difficulty. Supports 82 are disposed at the lower end of first housing member 14 which serve to mount a particular module in place relative to the housing. Removal or dismounting of a particular module is readily accomplished merely by pulling same from the housing interior.

FIGS. 2, 3, 4, 27 and 28 should now be referred to for details concerning the second module 22 and its interrelationship with the housing and dispenser actuator.

Second module 22 has a generally four-sided box-like configuration and includes a top wall 84 which is integral with the side walls thereof and which acts a support for bag-in-box liquid container 30. In the form illustrated, module 22 is hollow and has no moving parts. A recess 36 is formed in the top wall and the front side wall of the second module, said recess accommodating the outlet tube 88 extending from the bag of the bag-in-box liquid container and in fluid flow communication with the bag interior. In schematic FIGS. 27 and 28, the size of the tube 88 has been exaggerated relative to the size of the bag-in-box container per se for illustrative purposes. A bag-in-box liquid container of the type illustrated is known in the prior art and the illustrated bag-in-box liquid container is suitably of the known type wherein two valves (not shown) are in operative association with the flexible outlet tube, one of the valves being a one way check valve at the top of the tube allowing one way liquid flow into the tube and a second check valve at the lower end or exit end of the flexible tube which allows fluid to exit the lower end of the tube when external pressure is applied to the tube and the tube is compressed.

At the lower end thereof, the second module 22 defines a cavity 90 accommodating the distal end of the outlet tube whereby the second module maintains the lower end at a generally fixed location. In the vicinity of recess 86 the second module has a curved outlet tube engagement surface 92 which is disposed at the backside of the tube when the tube is in recess 86.

Inward movement of actuator body 62 by manual depression thereof will serve to compress the outlet tube 88 and thus cause dispensing of liquid from the bag-in-box liquid container. More specifically, such compression takes place after a slight modification is made to the dispenser actuator structure. Such modification is accomplished by attaching an outlet tube engagement member 94 to framework 64 by any suitable expedient. For example, suitable cooperative detents and indents may be provided to allow the outlet tube engagement member 94 to be snapped in place, it being understood that the member 94 can again be removed if one wishes to employ first module 20 rather than second module 22 in the system.

Figure 27:
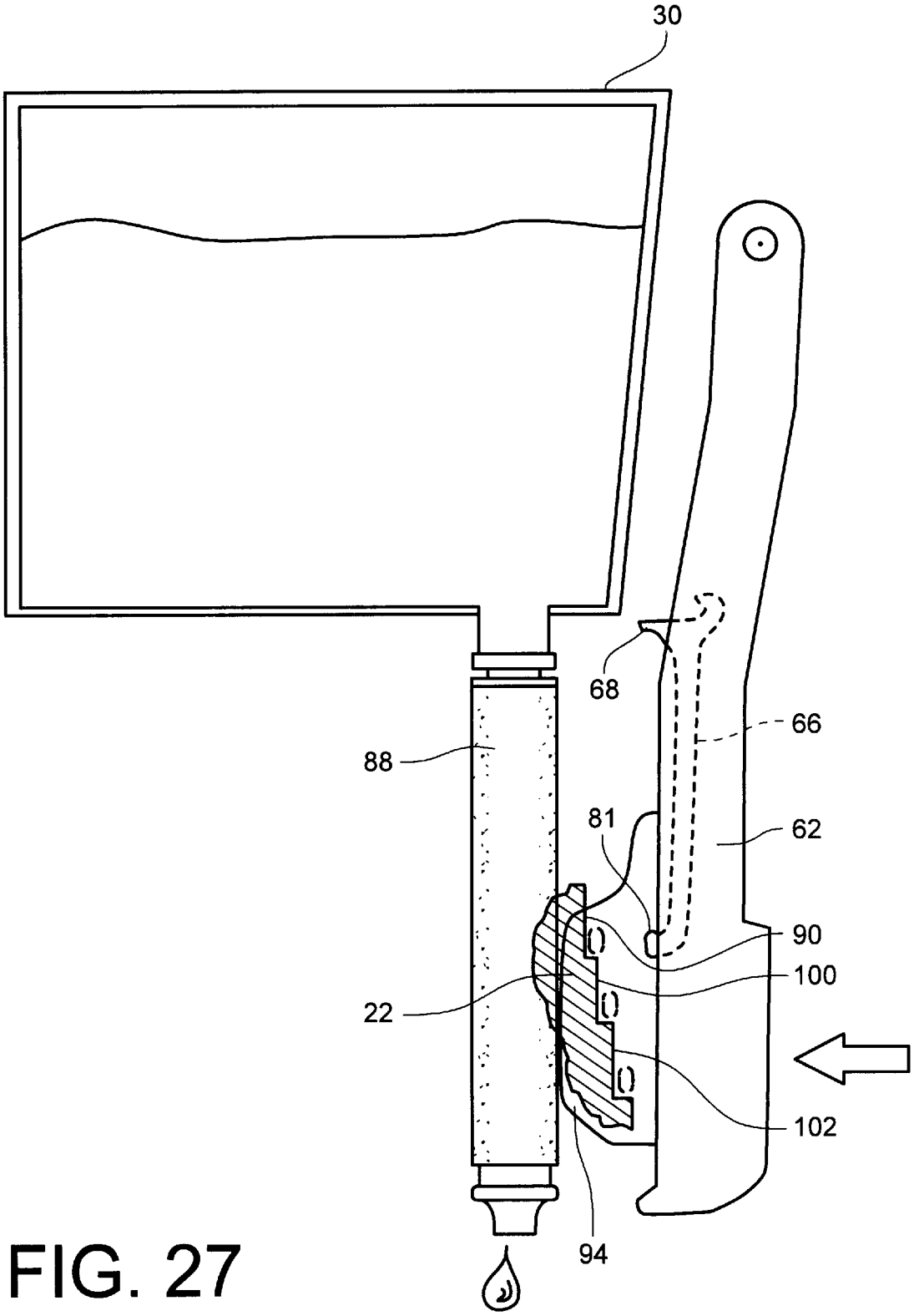
FIG. 27 is a partial, schematic, elevation view in partial section illustrating the cooperative relationship of the module employed to support a bag-in-box container, in particular the relationship between the outlet tube of the container and the dispenser actuator, and structure for limiting movement of the dispenser actuator.
Figure 28:
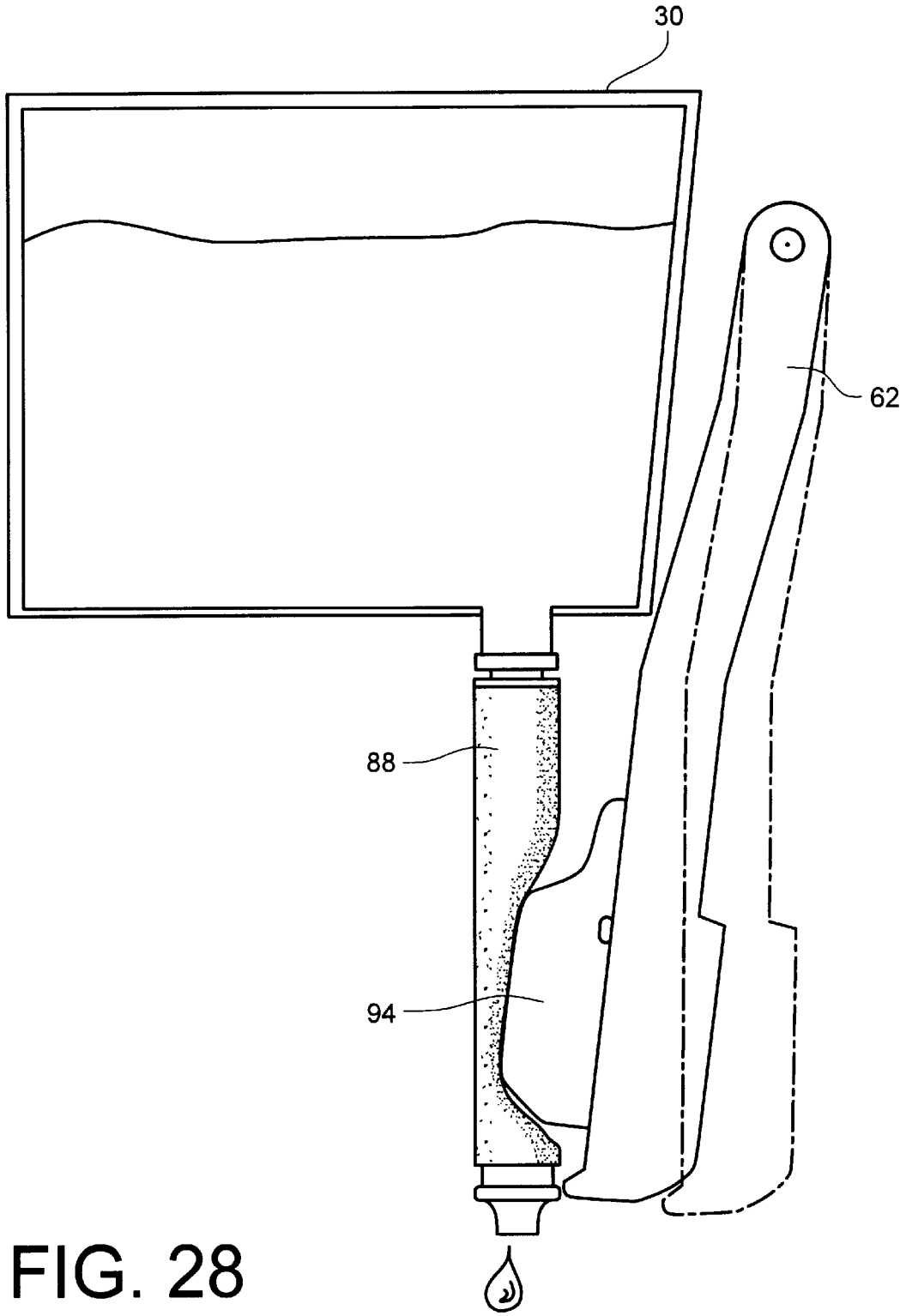
FIG. 28 is a view similar to FIG. 27 but illustrating compression of the outlet tube by the dispenser actuator and outlet tube engagement member attached thereto.

Inward pushing of the framework 64 results in the outlet tube 88 being compressed between the outlet tube engagement surface 92 and the outlet tube engagement member 94, the degree of depression determining how much liquid is dispensed from the outlet tube. FIGS. 27 and 28 illustrate this schematically.

Second module 22 includes stepped walls 96 of a character similar to the stepped walls 74 of the first module 20, stepped walls 96 having abutment surfaces 98, 100, 102 (see FIG. 27) thereon. These abutment surfaces cooperate with adjustable contact member 66 in the manner previously described with respect to first module 20 so that control may be exercised over the amount of liquid dispensed by the apparatus.

Several other features of the apparatus are worthy of note. Among these are rib-like container engagement members 104 (FIG. 2) which project from the housing into the housing interior, the container engagement members being engageable by either the bag-in-box liquid container or the bottle of liquid to resist movement thereof while on their respective supports.

Figure 20:
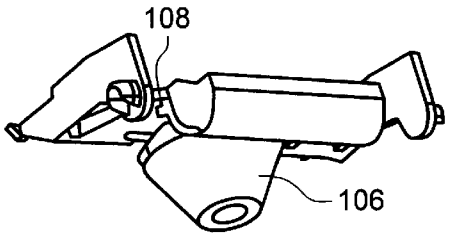
FIG. 20 is a bottom perspective view of the spout and hinge pin structure.
Figure 19:
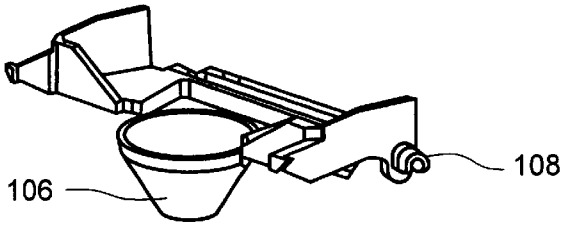
FIG. 19 is a top perspective view of spout and hinge pin structure employed in the apparatus.
Figure 22:
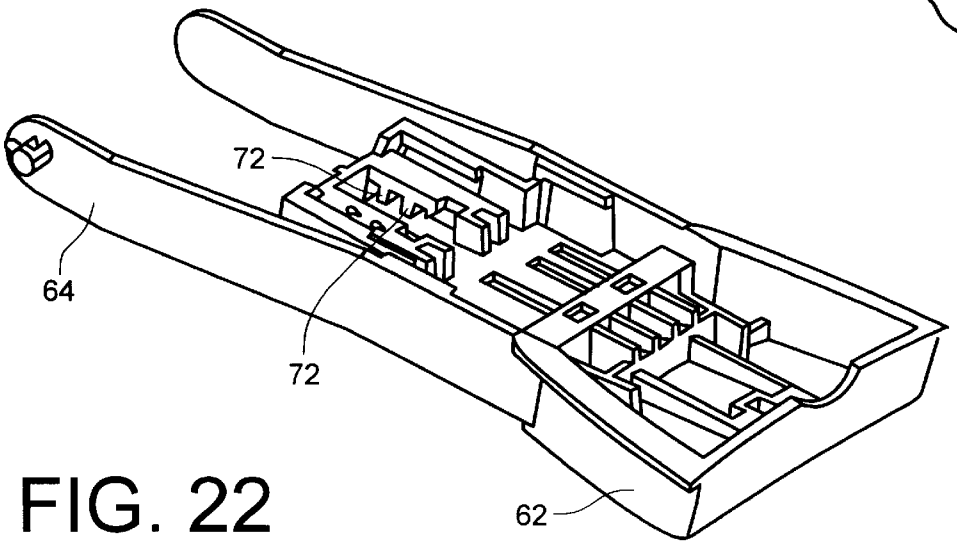
FIG. 22 is a rear perspective view of the actuator body framework as seen from the back thereof.
Figure 23:
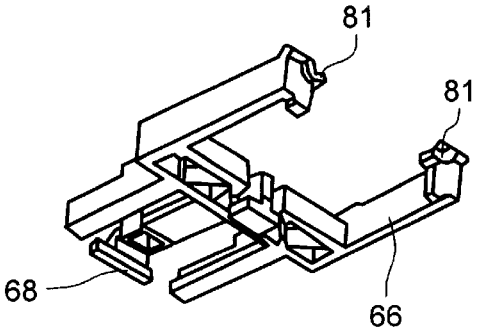
FIG. 23 is a perspective view of the contact member.
Figure 24:
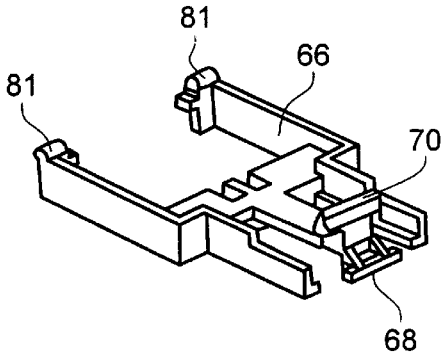
FIG. 24 is another perspective view of the contact member.
Figure 25:
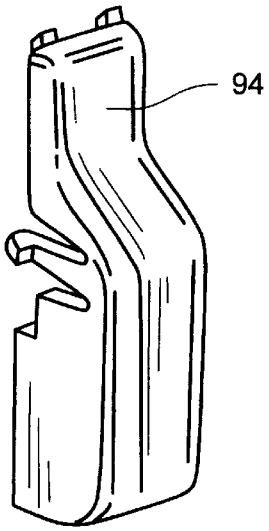
FIG. 25 is a frontal perspective view of the outlet tube engagement member employed in the apparatus.
Figure 26:
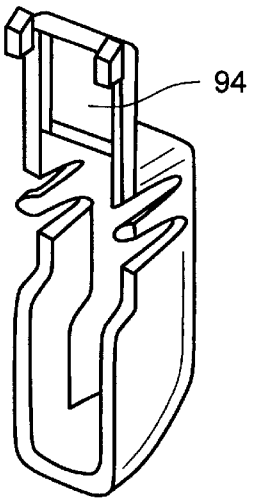
FIG. 26 is a rear perspective view of the outlet tube engagement member.

Housing 10 includes a downwardly extending spout 106 leading from the housing interior for receiving liquid from either a bag-in-box container having an outlet tube or from a bottle of liquid. The spout 106 acts as a cosmetic cover providing the same external appearance whether the system is configured as a dispenser employed with a bottle of liquid or with a bag-in-box liquid container. In the arrangement illustrated, spout 106 is attached to a hinge pin 108 (see FIGS. 19 and 20) employed to pivotally interconnect housing members 14, 16.

Another feature incorporated in the apparatus are view windows 110 which are positioned on the sides of the housing and located to permit observation of the soap level of the particular container utilized in the apparatus, whether it be the bottle or the bag-in-box liquid container. Placement of the view windows is such that they are disposed just above the support surfaces of the modules. Of course, to see the contents of the bag-in-box liquid container, an opening, such as opening 112, would also have to be formed in the box component of such container.

We claim:

1. Apparatus for dispensing liquid soap or other liquid from either a bag-in-box liquid container having an outlet tube or from a bottle of liquid, said apparatus comprising:

a housing defining a housing interior;

dispenser actuator means movably mounted on said housing;

a first module including a bottle support for supporting a bottle of liquid and a liquid pump for pumping liquid from said bottle;

a second module for insertion into said housing interior, said second module including a bag-in-box container support for supporting a bag-in-box container having liquid therein; and mounting means for selectively alternatively mounting said first module and said second module on said housing within said housing interior, each of said modules cooperable with said dispenser actuator means when in said housing interior to dispense liquid from said housing interior to a location exterior of said housing responsive to movement of said dispenser actuator means relative to said housing.

2. The apparatus according to claim 1 wherein said dispenser actuator means includes a manually engageable actuator member movable relative to said housing when force is applied thereto, said actuator member when force is applied thereto causing dispensing of liquid when one of said modules is mounted on said housing within said housing interior.

3. The apparatus according to claim 1 wherein said dispenser actuator means includes a moveable manually engageable member accessible exteriorly of said housing and an outlet tube engagement member within the housing interior moveable responsive to movement of said manually engageable member when said second module is in said housing interior supporting a bag-in-box liquid container having an outlet tube to compress the outlet tube and dispense liquid through the outlet tube.

4. The apparatus according to claim 3 wherein said outlet tube engagement member is releasably connected to and selectively detachable from the remainder of said dispenser actuator means.

5. The apparatus according to claim 3 wherein said second module includes an outlet tube engagement surface, the outlet tube being held between said outlet tube engagement surface and said outlet tube engagement member during compression of the outlet tube by said outlet tube engagement member.

6. The apparatus according to claim 1 including means for stopping movement of said dispenser actuator means relative to said housing to terminate dispensing of liquid from said housing interior.

7. The apparatus according to claim 6 wherein said means for stopping movement of said dispenser actuator means relative to said housing includes module engagement means connected to said dispenser actuator means engageable with a module within said housing interior.

8. The apparatus according to claim 7 wherein said module engagement means is adjustably connected to said dispenser actuator means to vary the amount of movement of said dispenser actuator means that must occur before engagement of said module engagement means with a module within the housing interior to control the amount of liquid dispensed.

9. The apparatus according to claim 8 wherein each of said modules has a plurality of abutment surfaces for selective alternate engagement by said module engagement means to limit movement of said dispenser actuator means and control the amount of liquid dispensed.

10. The apparatus according to claim 1 wherein said housing includes a downwardly extending spout leading from said housing interior for receiving liquid from either a bag-in-box container having an outlet tube or from a bottle of liquid.

11. The apparatus according to claim 10 wherein said housing includes a housing body and a relatively pivotally moveable housing cover pivoted about a hinge pin, said spout being connected to said hinge pin.

12. The apparatus according to claim 1 wherein at least one window is defined by said housing for observing the liquid contents of either said bag-in-box liquid container or said bottle of liquid.

13. The apparatus according to claim 1 wherein said mounting means includes at least one module support member projecting from said housing into said housing interior for releasably supporting said modules whereby said modules can readily be positioned or removed from said housing interior.

14. The apparatus according to claim 1 additionally including container engagement members projecting from said housing into the housing interior, said projecting container engagement members engageable by either said bag-in-box liquid container or said bottle of liquid to restrict movement thereof while on their respective supports.

15. The apparatus according to claim 1 wherein said first module defines a reservoir for receiving liquid from said bottle of liquid.

16. The apparatus according to claim 15 wherein said first module includes a cover defining an opening leading to said reservoir, said cover comprising said bottle support.

17. The apparatus according to claim 16 wherein said first module includes a bottle seal piercing element located at said opening.

18. The apparatus according to claim 16 wherein said cover additionally defines an air vent.

19. The apparatus according to claim 18 wherein said cover is removable and wherein at least a portion of said cover inclines downwardly toward said air vent to form a liquid drainage basin.

20. The apparatus according to claim 1 wherein said liquid pump of said first module includes a pump actuator for pushing by said dispenser actuator means upon movement of said dispenser actuator means relative to said housing.

21. Apparatus for dispensing liquid soap or other liquid said apparatus comprising:

a housing defining a housing interior and defining a liquid outlet communicating with said housing interior;

dispenser actuator means movably mounted on said housing; and means for adapting said housing to alternatively hold either a bag-in-box liquid container or a bottle of liquid comprising a plurality of interchangeable module means and cooperable with said dispenser actuator means upon movement thereof relative to said housing to dispense liquid from either a bag-in-box container or a bottle of liquid.

22. The apparatus according to claim 21 wherein said plurality of interchangeable module means includes first and second modules alternatively positionable on said housing in said housing interior, said first module including a bottle support for supporting a bottle of liquid and said second module including a bag-in-box container support for supporting a bag-in-box container having liquid therein.

23. The apparatus according to claim 22 wherein said first module additionally includes a liquid pump for pumping liquid from said bottle of liquid.

24. The apparatus according to claim 23 wherein said first module defines a reservoir for receiving liquid from said bottle of liquid for pumping by said liquid pump.

25. The apparatus according to claim 24 wherein said liquid pump includes a pump actuator for pushing by said dispenser actuator means during movement of said dispenser actuator means.

* * * * *